US008474584B2

(12) United States Patent
Mrocki et al.

(10) Patent No.: US 8,474,584 B2
(45) Date of Patent: Jul. 2, 2013

(54) TAMPER EVIDENCING BAND

(75) Inventors: Dion Mrocki, South Yarra (AU); Rod Anthony Wiebenga, Blackburn (AU); Jo Fleming, Blackburn (AU)

(73) Assignee: Securoseal Pty Ltd, South Yarra, Victoria (AU)

( * ) Notice: Subject to any disclaimer, the term of this patent is extended or adjusted under 35 U.S.C. 154(b) by 1158 days.

(21) Appl. No.: 12/089,810

(22) PCT Filed: Oct. 12, 2006

(86) PCT No.: PCT/AU2006/001510

§ 371 (c)(1),
(2), (4) Date: Apr. 10, 2008

(87) PCT Pub. No.: WO2007/041798

PCT Pub. Date: Apr. 19, 2007

(65) Prior Publication Data

US 2008/0257673 A1 Oct. 23, 2008

(30) Foreign Application Priority Data

Oct. 13, 2005 (AU) ..... 2005905670

(51) Int. Cl.
*A45C 13/18* (2006.01)
*A45C 13/10* (2006.01)

(52) U.S. Cl.
USPC ..... 190/101; 190/102; 40/6; 383/5

(58) Field of Classification Search
USPC ..... 190/25, 26, 101, 102; 206/807, 247; 220/214; 383/5; 283/101, 80; 294/31.2, 214, 294/150; 40/6, 630; 24/16 PB, 30.5 P
See application file for complete search history.

(56) References Cited

U.S. PATENT DOCUMENTS 902,695 A * 11/1908 Staley ..... 24/17 A
1,353,814 A * 9/1920 Emery ..... 190/27
3,231,992 A * 2/1966 Swett ..... 40/665

(Continued)

FOREIGN PATENT DOCUMENTS

AU 2005100766 A4 9/2005
CA 2015183 A1 10/1991

(Continued)

OTHER PUBLICATIONS

Written Opinion of the International Searching Authority for PCT/AU2006/001510.

(Continued)

*Primary Examiner* — Sue A Weaver
(74) *Attorney, Agent, or Firm* — David D. Brush; Westman, Champlin & Kelly, P.A.

(57) ABSTRACT

A tamper evidencing band for encircling an article includes an elongate strip. The band is provided with a loop. The loop is such that attempted opening or removal of the loop will be evidenced by the band. The strip has a portion distal from the loop, which is insertable through the loop. Attachment means is provided to selectively attach the distal portion onto another portion of the strip to encircle the article whereby attempted removal of the attachment will be evidenced by the band. The tamper evidencing band may be provided as a flat strip with the loop unformed. Alternatively, the tamper evidencing band may be provided in kit form with a separate buckle to define the loop.

38 Claims, 7 Drawing Sheets

U.S. PATENT DOCUMENTS

| | | | | | |
|---|---|---|---|---|---|
| 3,257,694 | A | * | 6/1966 | Litwin | 24/16 PB |
| 4,065,343 | A | | 12/1977 | Stumpe | |
| 4,081,882 | A | | 4/1978 | Toepelt et al. | |
| 4,379,538 | A | * | 4/1983 | Welles | 248/95 |
| 4,393,548 | A | * | 7/1983 | Herb | 24/16 PB |
| 4,501,049 | A | * | 2/1985 | Adamson | 24/30.5 P |
| 4,965,115 | A | * | 10/1990 | Cimillo | 428/131 |
| 5,224,244 | A | * | 7/1993 | Ikeda et al. | 24/16 PB |
| 5,399,021 | A | | 3/1995 | Litt | |
| 5,451,282 | A | | 9/1995 | Fore | |
| 5,510,768 | A | * | 4/1996 | Mann | 340/571 |
| 5,551,729 | A | | 9/1996 | Morgan | |
| 5,560,657 | A | | 10/1996 | Morgan | |
| 5,683,774 | A | | 11/1997 | Faykish et al. | |
| 5,881,435 | A | * | 3/1999 | Jermyn, Jr. | 24/16 PB |
| 5,882,320 | A | * | 3/1999 | Peterson | 602/3 |
| 5,890,345 | A | | 4/1999 | Bauer | |
| 6,003,208 | A | * | 12/1999 | Christian et al. | 24/16 PB |
| 6,050,622 | A | | 4/2000 | Gustafson | |
| 6,189,249 | B1 | | 2/2001 | Hughes | |
| 6,196,716 | B1 | | 3/2001 | Geyer | |
| 6,267,505 | B1 | | 7/2001 | Henson | |
| 6,364,365 | B1 | | 4/2002 | Caplan | |
| 6,372,341 | B1 | | 4/2002 | Jung et al. | |
| 6,430,974 | B1 | | 8/2002 | Mitchell et al. | |
| 6,694,655 | B2 | | 2/2004 | Redburn et al. | |
| 6,695,364 | B2 | | 2/2004 | Bierlin | |
| 7,861,835 | B2 | * | 1/2011 | Montross | 190/101 |
| 2002/0038744 | A1 | | 4/2002 | Sukoff | 190/101 |
| 2004/0101664 | A1 | | 5/2004 | Puttkammer | |
| 2004/0164564 | A1 | | 8/2004 | Redburn et al. | |
| 2004/0206431 | A1 | | 10/2004 | Metzig et al. | |
| 2005/0204515 | A1 | * | 9/2005 | Hewes | 24/16 PB |
| 2006/0225332 | A1 | | 10/2006 | Zenisek | |
| 2007/0221461 | A1 | | 9/2007 | Carmona | |

FOREIGN PATENT DOCUMENTS

| | | | |
|---|---|---|---|
| DE | 3340692 | A1 | 11/1983 |
| DE | 3340692 | A1 | 5/1985 |
| EP | 1026095 | A2 | 8/2000 |
| EP | 1028065 | A1 | 8/2000 |
| EP | 1037191 | A2 | 9/2000 |
| EP | 1347429 | A1 | 3/2002 |
| EP | 1347429 | A1 | 9/2003 |
| GB | 2150108 | A | 11/1984 |
| GB | 2150108 | A | 6/1985 |
| GB | 2403207 | A | 6/2003 |
| GB | 2388812 | A | 11/2003 |
| GB | 2415678 | A | 6/2004 |
| NZ | 514919 | A | 11/2003 |
| RU | 2225644 | C2 | 5/2002 |
| SU | 1795627 | A1 | 9/1996 |
| WO | 8802903 | A1 | 4/1988 |
| WO | 9312513 | A1 | 6/1993 |
| WO | 9701495 | A1 | 1/1997 |
| WO | 02070368 | A2 | 9/2002 |
| WO | 2006096908 | A1 | 9/2006 |
| WO | 2007041798 | A1 | 4/2007 |

OTHER PUBLICATIONS

International Search Report for PCT/AU2006/001510.

International-Type Search Report of Australian Application No. 2005/905670 filed Oct. 13, 2005.

International Search Report of Counterpart Application No. PCT/AU2006/001510 filed Oct. 12, 2006.

International Search Report of Application No. PCT/AU2008/000885 filed on Jun. 19, 2008.

Written Opinion of Counterpart Application No. PCT/AU2008/000855 Filed on Nune 19, 2008.

English Translation of Decision on Grant for corresponding Russian Application No. 2008118507, filed Oct. 12, 2006.

Election/Restriction Requirement from the United States Patent and Trademark Office for corresponding U.S. Appl. No. 12/665,581, dated Dec. 30, 2011.

Office Action dated May 11, 2012, from the United States Patent and Trademark Office for corresponding U.S. Appl. No. 12/665,581.

* cited by examiner

TAMPER EVIDENCING BAND

FIELD OF THE INVENTION

The present invention relates to a tamper evidencing band for securing about an article or part of an article which once secured cannot be removed without leaving evidence that the band has been tampered with. In particular, although not exclusively, the invention relates to a band used to secure an item of luggage.

BACKGROUND OF THE INVENTION

The transportation of articles, such as items of personal baggage, is an area of great concern. When baggage is transported there are invariably periods of time in which the baggage is susceptible to tampering. This may either be when baggage is left unattended, however briefly, by the owner, or may even occur after the baggage owner has handed over the baggage to the care of the transporters.

Tampering with such articles of baggage is becoming increasingly more common, and may well have disastrous effects. Tampering can include merely opening and rifling through the contents of a bag, stealing contents from a bag or even inserting items into a bag.

Given this increase in tampering, and the corresponding increase in awareness, there is a need for a simple way in which to secure items of baggage so as to be able to immediately ascertain whether the item has been tampered with.

The foregoing prior art discussion is not to be taken as an admission of common general knowledge.

SUMMARY OF THE INVENTION

In accordance with a first aspect of the invention, there is provided a tamper evidencing band for encircling an article, the band including an elongate strip, the band being provided with a loop, the provision of the loop being such that attempted opening or removal of the loop will be evidenced by the band, the strip having a portion distal from the loop which is insertable through the loop and provided with attachment means to selectively attach the distal portion onto another portion of the strip to encircle the article whereby attempted removal of the attachment will be evidenced by the band.

Preferably, the loop is provided by means of a buckle which is attached to the loop. The attachment should be done in such a manner that any attempt to remove the buckle will evidenced by the band. Preferably, the buckle is provided at a proximal portion of the strip and may be secured to the strip by inserting the proximal end of the strip through a loop of the buckle and attaching the proximal portion of the strip back onto itself. In an alternative form of the invention the loop may be provided by the strip itself by doubling over a proximal portion of the strip and securing it back on itself but leaving a loop of the strip unsecured to itself.

The nature of the formation or securement of the loop is such that any attempt to open the loop or remove the loop will be evidenced by the band. One way which this can be achieved is by ensuring that the adhesive bond required to form or secure the loop in the strip is stronger than the material of the strip itself. Therefore, upon attempted separation of adhered portions of the strip, the material of the strip will tear thus evidencing the attempt. Additionally, the strip may be formed to enhance the likelihood of a tear on attempted separation. This may be achieved by forming slits or lines of weakness in the strip such as chevron shaped slits. In an alternative form of the invention, the strip may be shaped with a pull tab which is narrower in width than the remainder of the strip and thereby encourages tearing longitudinally of the strip or along predefined line of weakness. Additionally, means may be provided to prevent or inhibit re-adhesion of the separated portions of the strip.

In a most preferred form of the invention, indicia are provided which indicate tampering. For example, on separation of adhered portions of the strip, a word may be revealed, such as "TAMPER".

In a particular form of the invention, the tamper evidencing portion securing or forming the loop may comprise a first portion and a second portion attachable to the first portion, the second portion having at least one securing portion and a detachable portion which may be irreversibly detached from the at least one securing portion.

Each of the at least one securing portions may be joined to the detachable portion by a frangible line with the force required to remove the at least one securing portion from the first portion being greater than the force required to break the frangible line. Each of the at least one securing portions may be attached to the first portion by nylon stitching. Preferably, each of the at least one securing portions may be attached to the first portion by an adhesive bond. The detachable portion may also incorporate the pull-tab which allows the detachable portion to be easily grasped.

In one embodiment, the first portion, the loop and the detachable portion form a common surface which is revealed on the formation of the open loop, and the common surface may be printed with the tamper indicating indicia.

In a most preferred form of the tamper evidencing band, the loop is provided already formed or secured within the band. The tamper evidencing band may then be applied to the article by: encircling the article with the strip; inserting the distal portion of the strip through the loop until the band is taut around the article; and attaching the distal portion of the strip onto an adjacent portion of the strip, depending upon the configuration of the strip around the article. The attachment is such that any attempt to remove the attachment will be evidenced by the band. The tamper evidencing of the distal portion may have any of the features described above for tamper evidencing of the loop.

The tamper evidencing band is suitably provided to the end user without the attachment of the distal portion of the strip, the attachment of the distal portion of the strip being undertaken by the end user to suit the size of the article. In order to make the attachment, at least a portion of the strip may comprise an adhesive layer and a removable backing layer. The removable backing layer may be removable in portions which when removed each expose a corresponding portion of the adhesive layer.

At least a portion of the strip may include one or more apertures. Each of the one or more apertures may be shaped to as to receive a second tamper-evidencing band extending transversely. The apertures are preferably in the form of slits or slots extending longitudinally in the strip.

Further, the strip may be provided with a detachable ticket portion which may be separated from the remainder of the strip and retained by the owner of the article. The detachable ticket portion may be provided as an end portion adjacent the distal portion of the strip.

In accordance with a second aspect of the present invention, there is provided a tamper evidencing band for encircling an article, the band including an elongate strip having a loop forming portion and a portion distal from the loop forming portion, the loop forming portion being formable into a loop such that once formed, attempted opening of the loop will be evidenced by the strip, the distal portion of the strip being insertable through the loop and provided with attachment means to selectively attach the distal portion onto another portion of the strip to encircle the article whereby attempted removal of the attachment will be evidenced by the band.

In accordance with a third aspect of the invention, there is provided a kit for a tamper evidencing band for encircling an article, including:

an elongate strip having a distal portion;

a loop which is attachable to the band in spaced disposition from the distal portion in such a manner that attempted removal of the loop will be evidenced by the band, the distal portion of the strip being insertable through the loop; and attachment means to selectively attach the distal portion onto another portion of the strip to encircle the article whereby attempted removal of the attachment will be evidenced by the band.

In accordance with a fourth aspect of the invention, there is provided a luggage strap for securing an item of luggage comprising an elongate strip and attachment means for securing the strip around the luggage item wherein the strip includes longitudinally extending slits or apertures to receive another luggage strap which extends transversely.

The terms "proximal" and "distal" used in relation to the strip are arbitrary terms used to label various portions of the strip and describe only their relative relationship to each other.

As used herein, the term "comprise" and variations of the term, such as "comprising", "comprises" and "comprised", are not intended to exclude other additives, components, integers or steps.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

The invention will now be described with reference to the accompanying drawings which show a preferred embodiment of the tamper evidencing band. It is to be understood, however, that the invention is not limited to the features of the preferred embodiment shown in the drawings.

Figure 13:
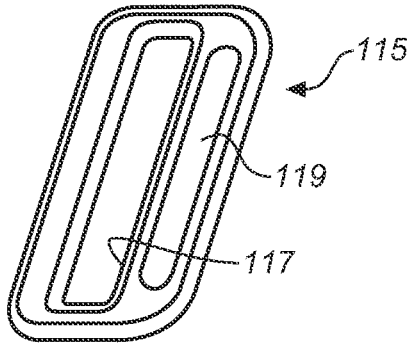
FIG. 13 is a perspective view of a buckle to be used in the band of FIG. 7.

*Fig*. 15 is a perspective view of a tamper evidencing band according to a second embodiment of the present invention with a loop portion created by the buckle of FIG. 13.

DETAILED DESCRIPTION OF THE EMBODIMENTS

Figure 1:
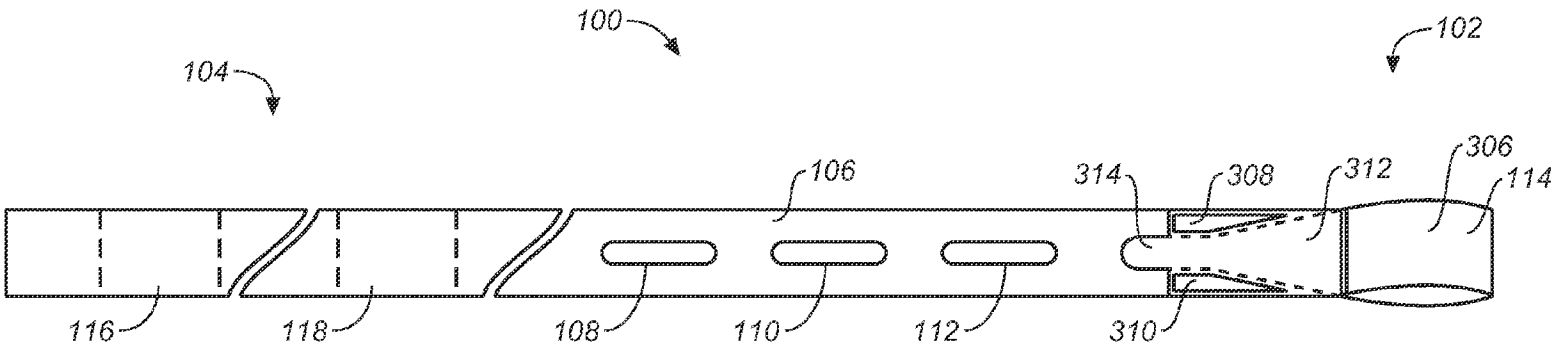
FIG. 1 provides a perspective view of a tamper evidencing band according to a first embodiment of the present invention with the loop portion creating a closed loop.

With reference to FIG. 1 the present invention provides a tamper evidencing band 100 for securing about an article or part of an article.

The tamper evidencing band 100 comprises a strip of Tyvek® brand protective material made by Dupont. Tyvek® is made from very fine high-density polyethylene fibres which are formed by flash-spinning. The fibres are randomly distributed and non-directional and are bonded together by heat and pressure—without the use of binders, sizers or fillers. The strip of Tyvek® material includes a tamper evidencing portion 102 at a first (proximal) end of the tamper evidencing band 100, an article securing portion 104 at a second (distal) end of the tamper evidencing band 100 and a body portion 106 extending between the tamper evidencing portion 102 and the article securing portion 104.

The body portion 106 is formed with a number of apertures 108, 110 and 112, each of which is shaped so as to be able to receive a second tamper evidencing band 100 through the aperture as will be described in connection with FIG. 4.

Figure 3:
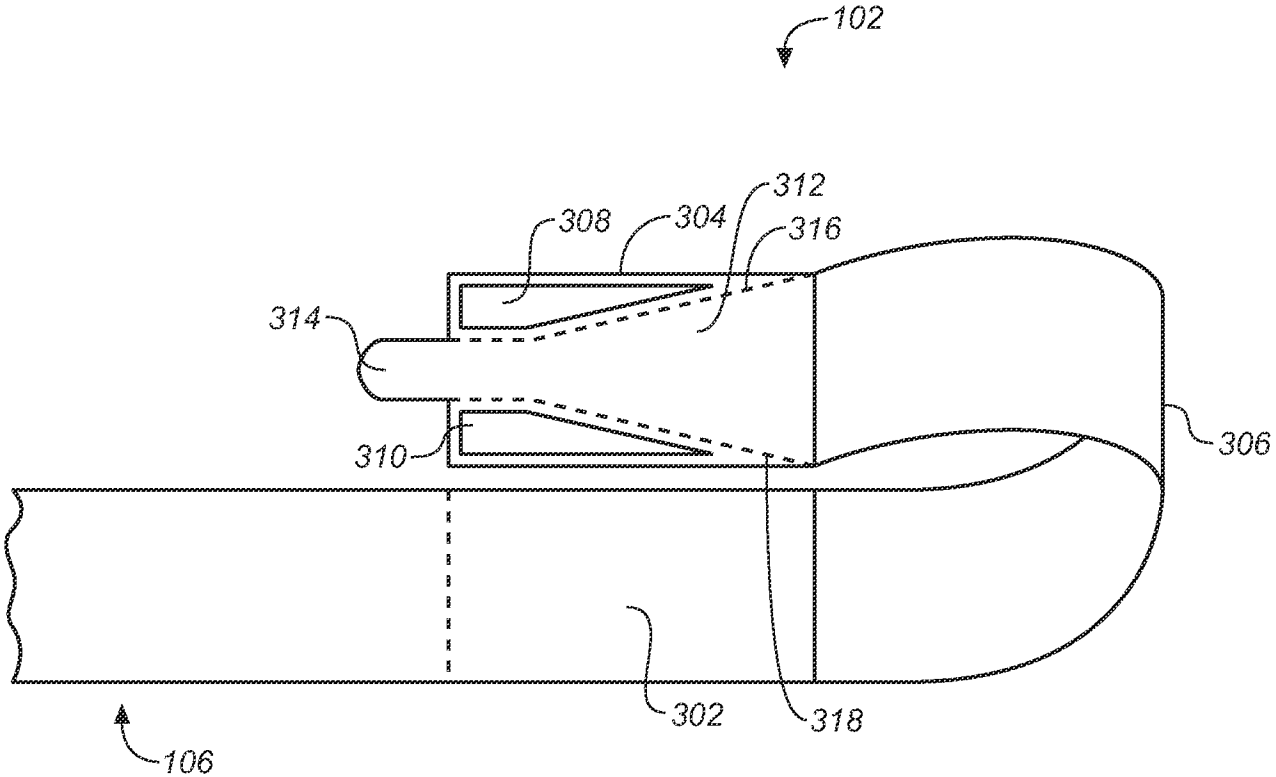
FIG. 3 provides a perspective view of the tamper evidencing portion of a tamper evidencing band according to the present invention.

As is best seen in FIG. 3, the tamper evidencing portion 102 comprises a first portion 302 proximate the body portion 106, a second portion 304 distal the body portion 106, and a loop portion 306 extending between the first portion 302 and the second portion 304.

The second portion 304 comprises a first securing portion 308, a second securing portion 310, and a detachable portion 312. Extending from the detachable portion 312 is a pull-tab 314, the pull-tab 314 shaped so as to be easily graspable by, for example, a thumb and finger. The detachable portion 312 is joined to the first securing portion 308 by a first frangible line 316, and the second securing portion 310 is joined to the detachable portion 312 by a second frangible line 318.

Prior to use of the tamper evidencing band 100, the first securing portion 308 and second securing portion 310 are both attached to the first portion 302. The attachment may be by any conventional means provided that the force required to remove the first securing portion 308 and the second securing portion 310 from the first portion 302 is greater than the force required to break the first frangible line 316 and second frangible line 318. One such form of attachment could be by nylon stitching through the first securing portion 308 and the first portion 302, and through the second securing portion 310 and the first portion 302. Alternatively an adhesive could be used to attach the first securing portion 308 and second securing portion 310 to the first portion 302.

When the first securing portion 308 and the second securing portion 310 are attached to the first portion 302, the loop portion 306 forms a closed loop 114 in the tamper evidencing portion 102 of the tamper evidencing band 100, clearly visible in FIG. 1.

Once this closed loop 114 has been formed the closed loop 114 may only be opened by either cutting the loop portion 306, or by pulling the pull-tab 314. As the attachment between the first and second securing portions 308, 310 and the first portion 302 are both stronger than the first frangible line 316 and second frangible line 318, pulling the pull-tab 314 causes both the first frangible line 316 and second frangible line 318 to break, releasing the detachable portion 312 from the first and second securing portions 308, 310. When the detachable portion 312 is released from the first securing portion 308 and the second securing portion 310, the loop portion 306 forms an open loop 204, clearly visible in FIG. 2.

Figure 2:
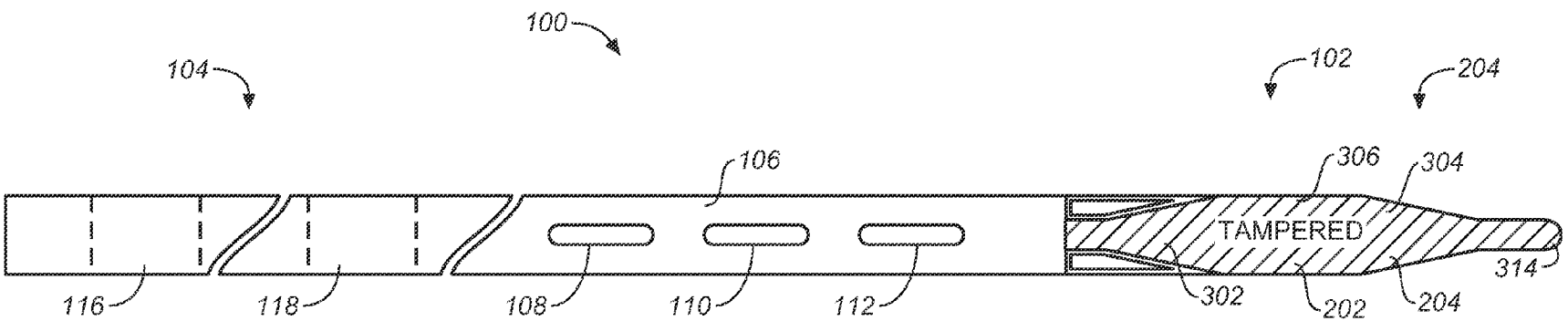
FIG. 2 provides a top view of a tamper evidencing band with the loop portion creating an open loop.

Also clearly visible in FIG. 2, a common surface 202 is formed by one surface of each of the first portion 302, loop portion 306 and detachable portion 312. When the open loop 204 is formed the whole of the common surface 202 is clearly visible. The common surface is printed with a tamper indicating indicia 204 extending the length of the common surface 202 which, in this case, clearly shows the word 'TAMPERED'.

It will of course be appreciated that the tamper indicating indicia 204 printed on the common surface 202 may be made up of any words, colours, pictures or patterns.

Figure 6:
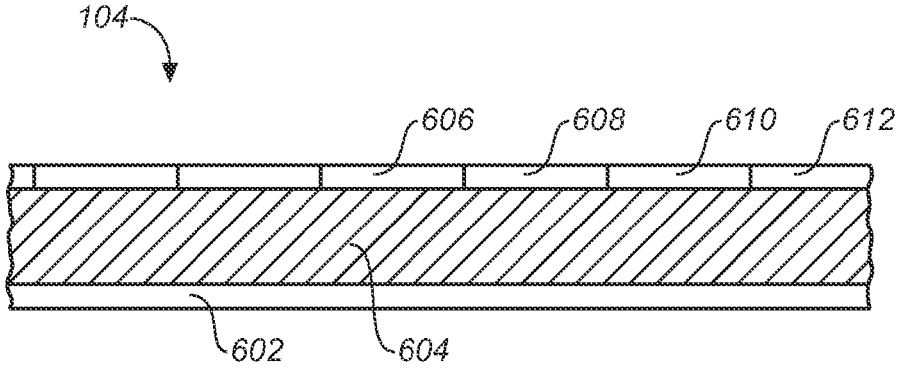
FIG. 6 provides a cross-sectional view of a part of the securing portion of a tamper evident band according to the present invention.
Figure 7:
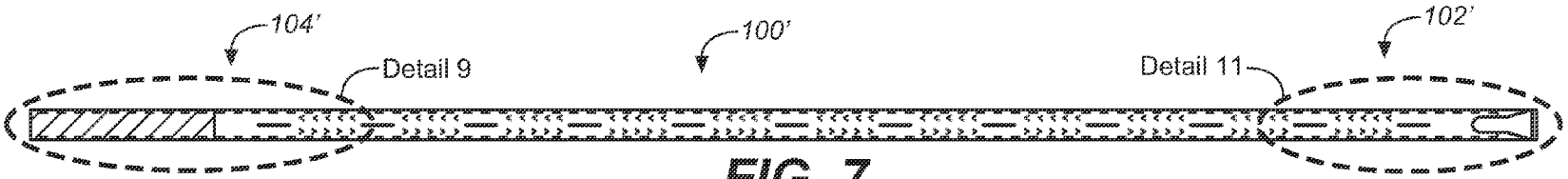
FIG. 7 is a plan view of a second preferred embodiment of a tamper evidencing band according to the present invention.
Figure 8:
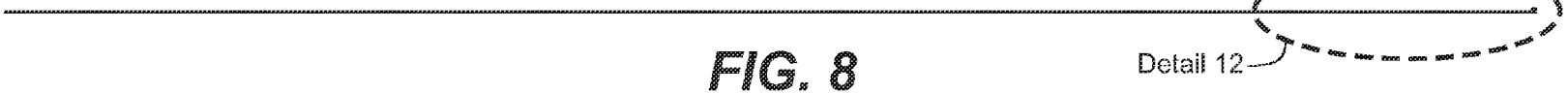
FIG. 8 is a side view of the band of FIG. 7.

The article securing portion 104, at the opposite end of the tamper evidencing band 100 to the tamper evidencing portion 102, is used to secure the band 100 about an article. The article securing portion 104 comprises a first part 116 distal the tamper evidencing portion 102 and a second part 118 proximate the tamper evidencing portion. As shown in FIG. 6, at least one of the first part 116 and the second part 118 comprise an adhesive layer 604 atop the band 602, and a removable backing layer 606 covering the adhesive layer 604. The removable backing layer comprises several removable backing layer portions 608, 610 and 612, each of which may be removed independently to expose part of the adhesive layer 604.

As can be appreciated from the foregoing description, the tamper evidencing band 100 of the present invention can be simply and cost-effectively manufactured from a single continuous band.

The tamper evidencing band 100 may be supplied to the user in the form shown in FIG. 1 with the loop already formed. Alternatively, the band 100 may be supplied without the loop being formed, so that the user forms the loop prior to installation of the band.

In order to secure the tamper evidencing band 100 about an article, the first part 116 of the article securing portion 104 is passed around the article to be secured and inserted through the closed loop 114 of the tamper evidencing portion 102. As many removable portions 608, 610 and 612 of the article securing portion 104 as is desired are removed to expose at least part of the adhesive layer 604. The first part 116 is then attached anywhere along the strip from the second part 118 including the body portion 106, depending on the girth of the article. FIG. 4 shows a tamper evidencing band 402 secured about an empty space. The adhesive bond which will be formed between the article securing portion 104 and the part of the strip to which it is secured is such that it will be stronger than the material of the strip itself. This will render the attachment tamper evident because any attempt to separate the first part 116 and the second part 118 will result in the strip material tearing. Further, the strip material could be configured with slits which enhance tearing in the event of attempted detachment.

Once the tamper evidencing band 100 has been secured about an article, as described above, it is not possible to release the tamper evidencing band 100 without leaving evidence of removal. The easiest way to remove the tamper evidencing band 100 from the article is by pulling the pull tab 314. As described above, this causes the first frangible line 316 and second frangible line 318 to break, releasing the detachable portion 312 and creating the open loop 204. Once the open loop 204 has been created, the article securing portion 104 is freed which allows for the tamper evidencing band 100 to be removed from the article. Once broken, however the first frangible line 316 and second frangible line 318 cannot be rejoined, leaving several clear signs of tampering in the tamper evidencing band 100.

Signs of tampering include the broken frangible lines 316 and 318, or in the event that the tamper evidencing band 100 has been removed entirely from the article, the fact that the tamper evidencing band 100 is not present at all.

The most obvious sign of tampering in the event that the frangible lines 316 and 318 have been broken is found in the tamper indicating indicia 204 formed on the common surface 202 which becomes clearly visible when the open loop 204 is formed.

The tamper evidencing band 100, of course, may also be removed by cutting or breaking the tamper evidencing band 100 at any point, in which case the band cannot be joined back together without leaving evidence of tampering.

The tamper evidencing band 100 will also show evidence of tampering if there has been an attempt to separate the article securing portion to where it is attached to the strip. Such signs may include tearing or distortion of the material in the strip.

Once the passenger arrives at their destination, if the band is intact then they may proceed to unpack their luggage by simply pulling on the pull tag 314. This is particularly beneficial since travellers are at the present time, not permitted to carry sharp instruments.

Figure 4:
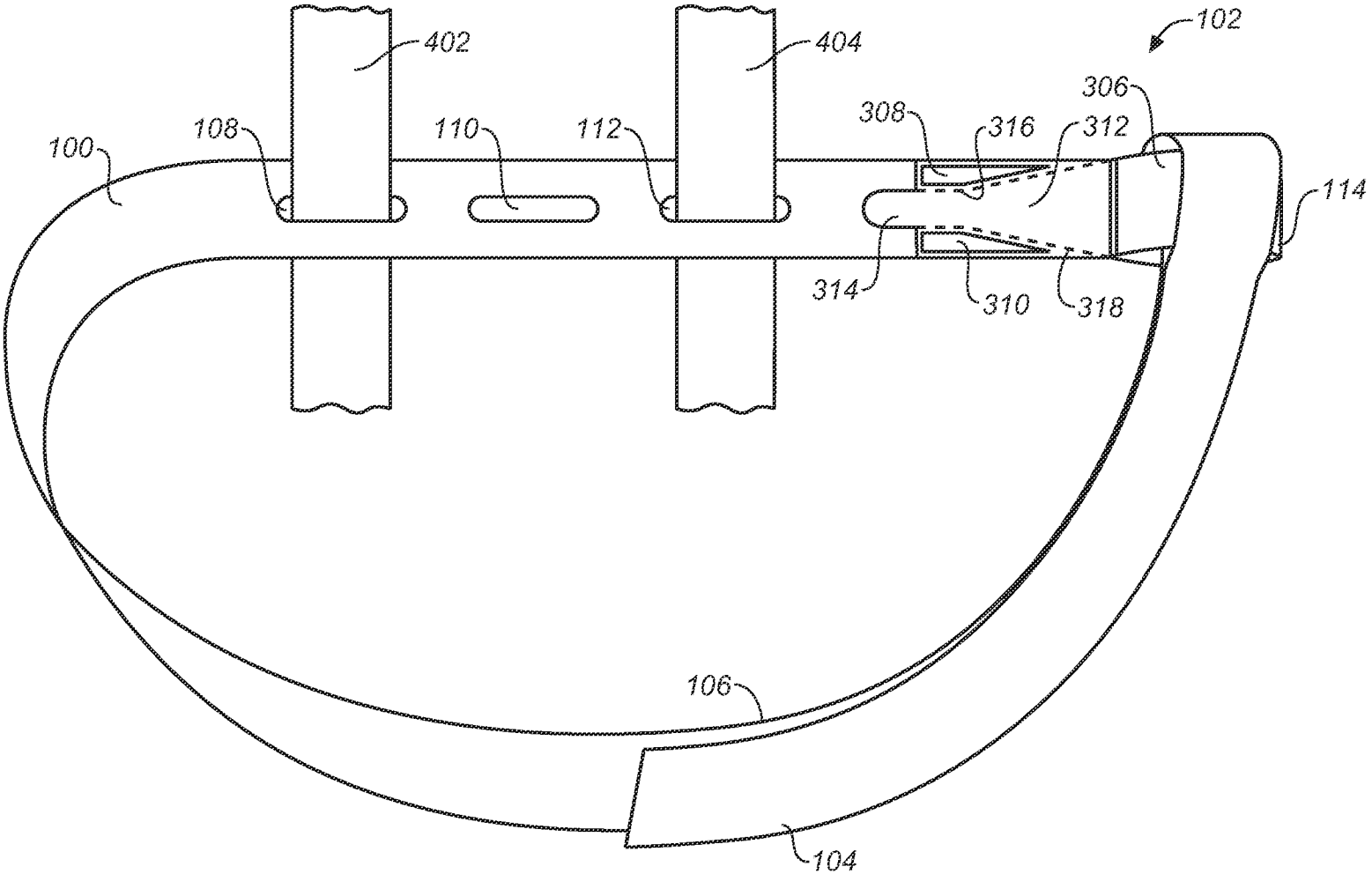
FIG. 4 provides a perspective view of a tamper evidencing band according the present invention secured about an empty space.
Figure 5:
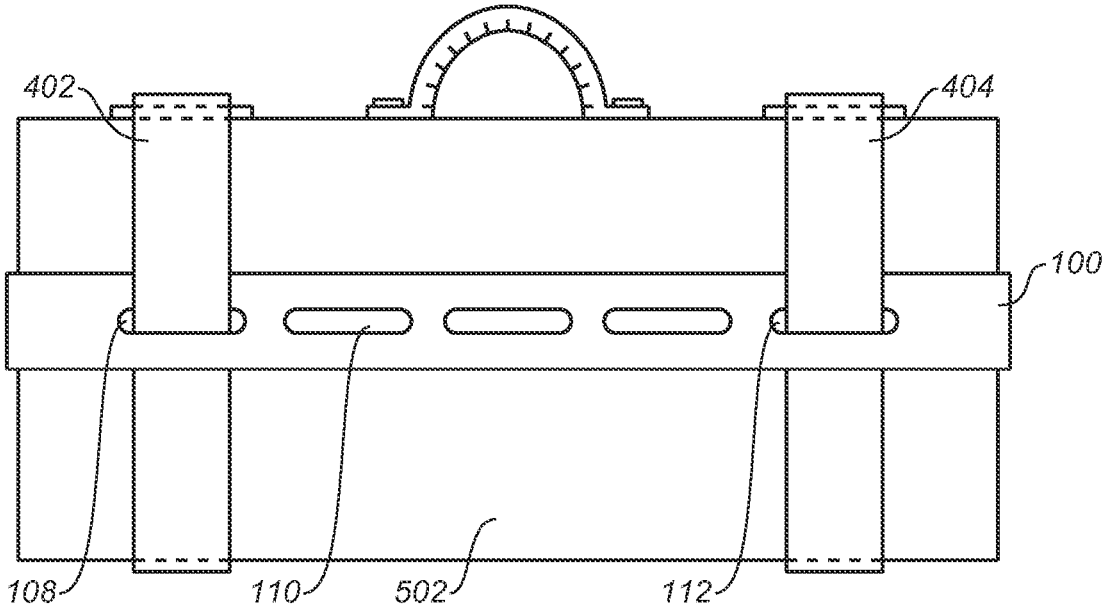
FIG. 5 provides a front view of an article secured by 3 tamper evident bands according to the present invention.

FIGS. 4 and 5 illustrate how three tamper evidencing bands 100, 402 and 404, may be used to secure an article 502. In FIG. 4 the article 502 has been omitted from the drawing so as to clearly show the securing of the tamper evidencing band 100, and in FIG. 5 the article 502 is a suitcase.

The first tamper evidencing band 100 is passed around the article 502 and secured according to method described above. In order to provide even greater security, two more tamper evidencing bands 402 and 404 are passed through the apertures 108 and 112 in the body 106 of the first tamper evidencing band 402 and secured about the article 502, again in the same manner as described above.

FIGS. 7 to 14 show an alternative form of the invention which is similar in many respects to the first embodiment. Thus, like numerals represent like parts, with the addition of a prime symbol (') to indicate the parts in the second embodiment which may be modified to suit the second embodiment.

The tamper evidencing band 100' in the second embodiment includes an elongate strip as with the first embodiment. The main difference is that while the tamper evidencing portion 102' still forms a loop 114', this loop is not intended to receive the distal end 104' of the strip. Instead, the loop 114' accommodates a buckle 115 as shown in FIG. 13. The buckle 115 defines a loop 117 through which the distal end 104 of the strip passes. It is intended that the tamper evidencing band 100' will be provided to end users with the buckle 115 already attached. Alternatively, the band may be provided in kit form with the strip and buckle separate. The end user on use of the band 100' inserts the distal portion 104' through the loop 117 of the buckle 115 and secures the band 100' around the article as is described in connection with the first embodiment. The buckle 115 also 20 includes a recessed area 119 for insertion of advertising material, logo or another identifier such as a serial number. Each band 100' may be provided with its unique serial number identifier.

Figure 9:
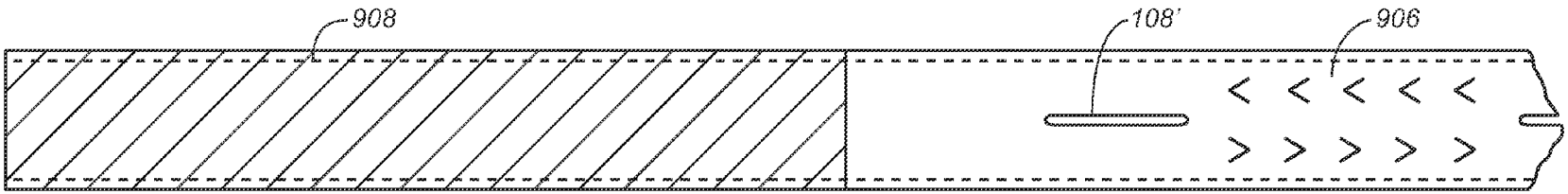
FIG. 9 is a detailed view of FIG. 7.
Figure 11:
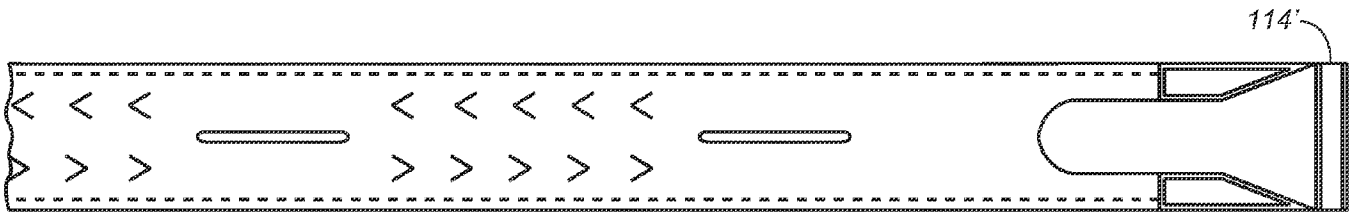
FIG. 11 is a detailed view of FIG. 7.
Figure 12:
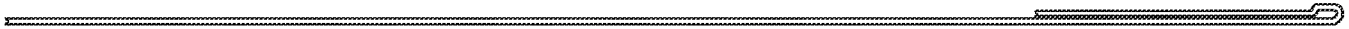
FIG. 12 is a detailed view of FIG. 8.
Figure 10:
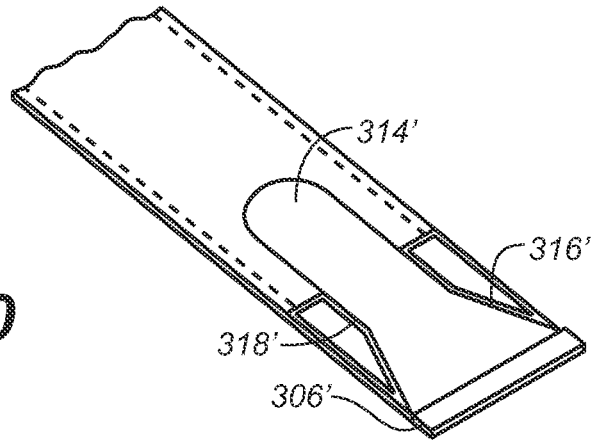
FIG. 10 is a perspective view of the proximal end of the band of FIG. 7.

FIG. 9 is a detailed view of the distal portion 104'. The distal portion 104' is adhesive backed with a release paper (not shown) which the end user removes in order to secure the band 100' to a selected portion of the body portion 106, depending on the girth of the article. The body portion 106' is also provided with chevron shaped slits 906 as shown which will enhance tearing on attempted separation of the distal portion 104' from the portion of the body portion 106' to which it is attached. Additionally, the strip may be provided with micro-printing which distorts when the distal portion 104' is removed from the part of the strip to which it is attached. This may be an overall print design. The band 100' is also reinforced with nylon stitching 908 about the periphery of the strip. As shown in FIG. 10, the nylon stitching 908 may also extend along the frangible tear lines 316' and 318'.

Another feature of this tamper evidencing band 100' is that instead of the slots 108, 110, 112, the band 100' is provided with slits 108'. The slits enable the passage of additional bands in the manner shown in FIG. 4.

Figure 14:
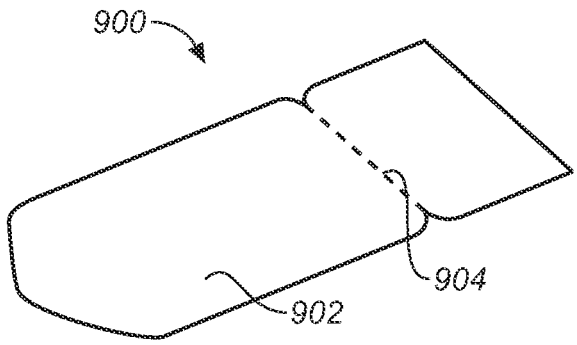
FIG. 14 is a detailed view of a ticket portion to be incorporated into the band of FIG. 7.
Figure 15:
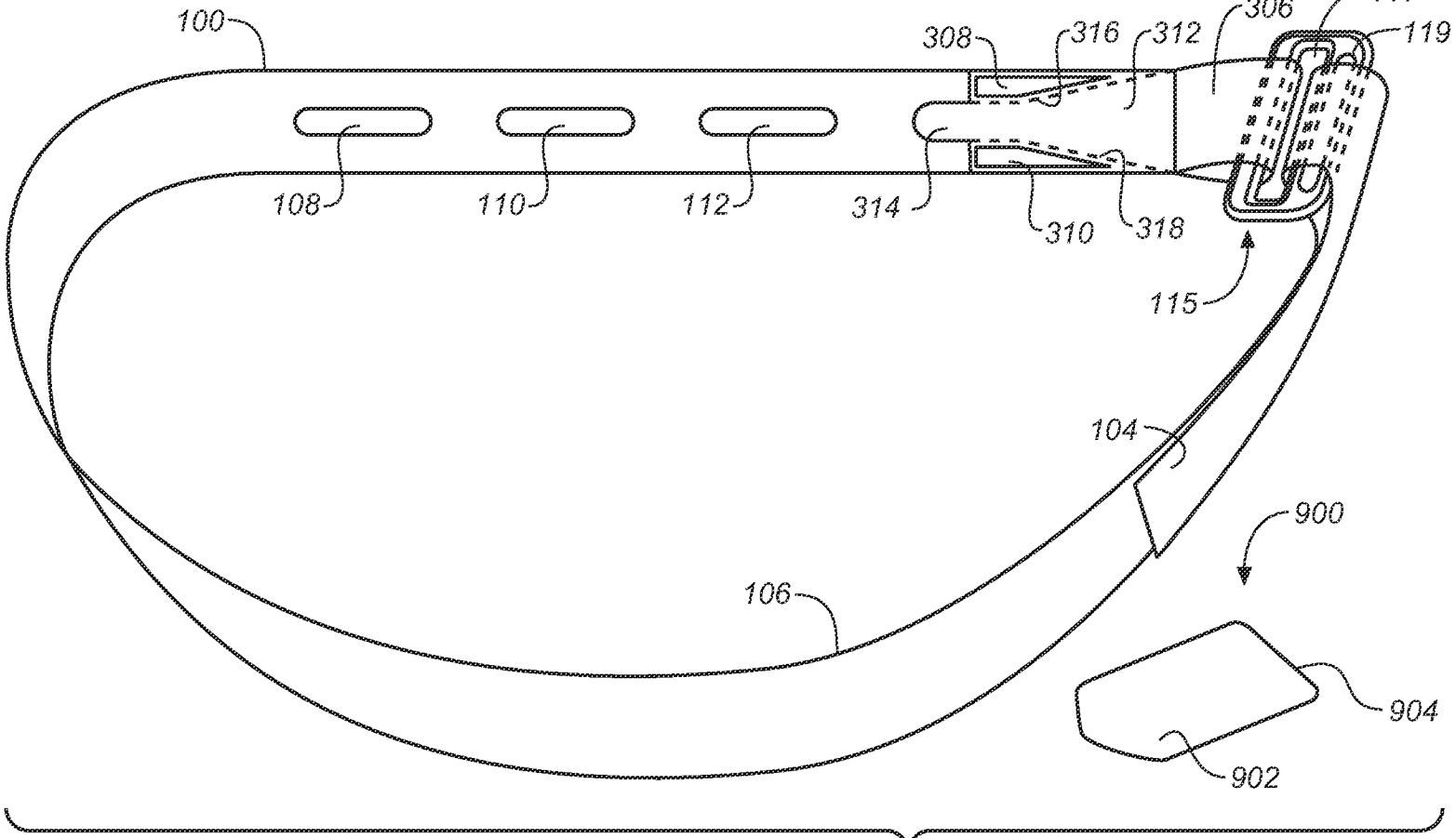

FIG. 14 illustrates an additional feature of the band 100'. FIG. 14 illustrates the configuration of a ticket portion 900 which may be incorporated into the band 100'. The ticket portion 900 includes a separable receipt portion 902 which is retained by the traveller. This receipt portion 902 may be provided with a unique serial number which corresponds to the unique serial number provided in the recess 119 or elsewhere on the band 100'. This enables the traveller's receipt portion to be associated with the correct item of luggage. The ticket portion 900 may be a discreet portion as shown in FIG. 14 which is adhered to the end of the distal portion 104'. The receipt portion 902 may then be detached by separating it along frangible line 904. Alternatively, the receipt portion 902 may be formed as an integral portion of the strip.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A tamper evidencing band for encircling an article, the band including:

an elongate strip to encircle the article, the elongate strip being formed of strip material, a tamper evidencing loop, the strip having a distal portion which is distal from the loop, the distal portion being insertable through the loop and foldable back onto itself, the distal portion being provided with adhesive to selectively attach the distal portion onto another portion of the strip to form an adhesive attachment therewith, the adhesive attachment being stronger than the strip material whereby attempted removal of the adhesive attachment will be evidenced by the band, wherein the strip comprises a detachable ticket portion which is separable from the remainder of the strip for retention by an owner of the article, the detachable ticket portion including a unique identifier corresponding to a unique identifier provided elsewhere on the band.

2. The tamper evidencing band as claimed in claim 1 wherein the loop is provided by a buckle which is attached to the strip.

3. The tamper evidencing band as claimed in claim 2 wherein the strip has a proximal end and a proximal portion and the buckle has an aperture and wherein the buckle is secured to the strip by inserting the proximal end of the strip through the aperture of the buckle and attaching the proximal portion of the strip back onto itself such that attempted removal of the buckle will be evidenced by the strip or the buckle.

4. The tamper evidencing band as claimed in claim 1 wherein the strip has a proximal portion which is doubled over and secured back on itself leaving a portion of the strip unsecured to itself to define the loop.

5. The tamper evidencing band as claimed in claim 1 wherein the strip is formed with slits or lines of weakness to enhance the likelihood of a tear on attempted separation of the distal portion from said another portion of the strip.

6. The tamper evidencing band as claimed in claim 1 wherein at least a portion of the strip includes one or more apertures for receiving a second tamper-evidencing band extending transversely.

7. The tamper evidencing band as claimed in claim 1 wherein the detachable ticket portion is attached to the distal portion of the band.

8. The tamper evidencing band as claimed in claim 7 wherein a frangible line is provided between the distal portion and the detachable ticket portion, the detachable ticket portion being detachable from the distal portion by separating it along the frangible line.

9. The tamper evidencing band as claimed in claim 1 wherein the loop includes a tamper evidencing portion which comprises at least one securing portion and a detachable portion which may be irreversibly detached from the at least one securing portion.

10. The tamper evidencing band as claimed in claim 9 wherein the detachable portion includes a pull tab.

11. The tamper evidencing band as claimed in claim 9 wherein the tamper evidencing portion comprises a first portion and a second portion attachable to the first portion, wherein the second portion includes the at least one securing portion and the detachable portion.

12. A tamper evidencing band for encircling an article, the band including an elongate strip to encircle the article, the elongate strip being formed of strip material, the strip having a loop forming portion and a distal portion which is distal from the loop forming portion, the loop forming portion being formable into a tamper evidencing loop, the distal portion of the strip being insertable through the loop and foldable back onto itself, the distal portion being provided with adhesive to selectively attach the distal portion onto another portion of the strip to form an adhesive attachment therewith, the adhesive attachment being stronger than the strip material whereby attempted removal of the adhesive attachment will be evidenced by the strip, wherein the strip comprises a detachable ticket portion which is separable from the remainder of the strip for retention by an owner of the article, the detachable ticket portion including a unique identifier corresponding to a unique identifier provided elsewhere on the band.

13. The tamper evidencing band as claimed in claim 12 wherein the loop forming portion is doubled over and secured back on itself leaving a portion of the strip unsecured to itself to define the loop.

14. The tamper evidencing band as claimed in claim 12 wherein securement of the loop is by an adhesive bond which is stronger than the material of the strip or at least of sufficient strength to cause distortion or tearing of the material of the strip.

15. The tamper evidencing band as claimed in claim 12 wherein the strip is formed with slits or lines of weakness to enhance the likelihood of a tear on attempted separation of the distal portion from said another portion of the strip.

16. The tamper evidencing band as claimed in claim 12 wherein at least a portion of the strip includes one or more apertures for receiving a second tamper-evidencing band extending transversely.

17. The tamper evidencing band as claimed in claim 12 wherein the detachable ticket portion is attached to the distal portion of the band.

18. The tamper evidencing band as claimed in claim 17 wherein a frangible line is provided between the distal portion and the detachable ticket portion, the detachable ticket portion being detachable from the distal portion by separating it along the frangible line.

19. A kit for a tamper evidencing band for encircling an article, including:

an elongate strip to encircle the article, the elongate strip being formed of strip material and having a distal portion;

a tamper evidencing loop which is attachable to the band in spaced disposition from the distal portion, the distal portion of the strip being insertable through the loop and foldable back onto itself; and adhesive to selectively attach the distal portion onto another portion of the strip to form an adhesive attachment therewith, wherein the adhesive attachment is stronger than the strip material whereby attempted removal of the adhesive attachment will be evidenced by the band, and wherein the strip comprises a detachable ticket portion which is separable from the remainder of the strip for retention by the owner of the article, the detachable ticket portion including a unique identifier corresponding to a unique identifier provided elsewhere on the band.

20. The kit as claimed in claim 19 wherein the loop is in the form of a buckle.

21. The kit as claimed in claim 20 wherein the strip has a proximal end and a proximal portion and the buckle has an aperture and wherein the buckle is secured to the strip by inserting the proximal end of the strip through the aperture of the buckle and attaching the proximal portion of the strip back onto itself such that attempted removal of the buckle will be evidenced by the strip.

22. The kit as claimed in claim 19 wherein at least a portion of the strip includes one or more apertures for receiving a second strip extending transversely.

23. The kit as claimed in claim 19 wherein the strip is formed with slits or lines of weakness to enhance the likelihood of a tear on attempted separation of the distal portion from said another portion of the strip.

24. The kit as claimed in claim 19 wherein the detachable ticket portion is attached to the distal portion of the band.

25. The kit as claimed in claim 19 wherein a frangible line is provided between the distal portion and the detachable ticket portion, the detachable ticket portion being detachable from the distal portion by separating it along the frangible line.

26. The kit as claimed in claim 19 wherein the loop includes a tamper evidencing portion which comprises at least one securing portion and a detachable portion which may be irreversibly detached from the at least one securing portion.

27. The kit as claimed in claim 26 wherein the detachable portion includes a pull tab.

28. The kit as claimed in claim 26 wherein the tamper evidencing portion comprises a first portion and a second portion attachable to the first portion, wherein the second portion includes the at least one securing portion and the detachable portion.

29. A method of protecting an article or baggage during transportation including:

providing a tamper evidencing band including an elongate strip formed of strip material, and a tamper evidencing loop, the strip having a distal portion which is distal from the tamper evidencing loop and is provided with adhesive which is stronger than the strip material, wherein the band further includes a detachable ticket portion which is separable from the remainder of the strip, the detachable ticket having a unique identifier corresponding to a unique identifier provided elsewhere on the band;

encircling the article or baggage with the band;

inserting the distal portion through the tamper evidencing loop;

folding the distal portion back onto itself;

attaching the distal portion onto another portion of the strip by the adhesive to form an adhesive attachment therewith, wherein the adhesive attachment is stronger than the strip material whereby attempted removal of the adhesive attachment will be evidenced by the band;

detaching the ticket portion from the remainder of the strip; and on receipt of the article or baggage at a destination, authenticating the article or baggage by inspecting the tamper evidencing band and the tamper evidencing loop and comparing the unique identifiers on the detachable ticket portion and the band.

30. The method as claimed in claim 29 wherein the detachable ticket portion is detached prior to the step of encircling.

31. The method as claimed in claim 30 wherein the detachable ticket portion is detached from the distal portion of the band.

32. The method as claimed in claim 29 wherein the loop is provided by means of a buckle which is attached to the strip.

33. The method as claimed in claim 29 wherein the strip has a proximal end and a proximal portion and the buckle has an aperture and wherein the buckle is secured to the strip by inserting the proximal end of the strip through the aperture of the buckle and attaching the proximal portion of the strip back onto itself such that attempted removal of the buckle will be evidenced by the strip or the buckle.

34. The method as claimed in claim 29 wherein the strip has a proximal portion which is doubled over and secured back on itself leaving a portion of the strip unsecured to itself to define the loop.

35. The method as claimed in claim 29 wherein at least a portion of the strip includes one or more apertures, the method further comprising encircling the article or baggage with a second tamper evidencing band extending transversely and inserting the second tamper evidencing band through one of said one or more apertures.

36. The method as claimed in claim 29 wherein the loop includes a tamper evidencing portion which comprises at least one securing portion and a detachable portion, the method further including detaching irreversibly the detachable portion from the at least one securing portion.

37. The method as claimed in claim 36 wherein the detachable portion includes a pull tab.

38. The method as claimed in claim 37 wherein the tamper evidencing portion comprises a first portion and a second portion attachable to the first portion, wherein the second portion includes the at least one securing portion and the detachable portion.

* * * * *